US009564013B2

(12) United States Patent
Jaffe

(10) Patent No.: US 9,564,013 B2
(45) **Date of Patent: *Feb. 7, 2017**

(54) WAGER SELECTIONS FOR WAGERING GAMES TRUNCATED BY PRIOR WAGE LEVEL

(71) Applicant: Bally Gaming, Inc., Las Vegas, NV (US)

(72) Inventor: Joel R. Jaffe, Glenview, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/809,794

(22) Filed: Jul. 27, 2015

(65) Prior Publication Data

US 2015/0332559 A1 Nov. 19, 2015

Related U.S. Application Data

(63) Continuation of application No. 13/796,967, filed on Mar. 12, 2013, now Pat. No. 9,123,211.

(51) Int. Cl.
*G07F 17/32* (2006.01)
*G07F 17/34* (2006.01)

(52) U.S. Cl.
CPC ..... *G07F 17/3258* (2013.01); *G07F 17/3213* (2013.01); *G07F 17/3244* (2013.01); *G07F 17/3267* (2013.01); *G07F 17/34* (2013.01)

(58) Field of Classification Search
CPC . G07F 17/326; G07F 17/3265; G07F 17/3267
USPC ..... 463/16–20
See application file for complete search history.

(56) References Cited

U.S. PATENT DOCUMENTS

| | | | |
|---|---|---|---|
| 6,575,829 | B2 | 6/2003 | Coleman |
| 7,100,916 | B2 | 9/2006 | Kelly |
| 7,278,635 | B2 | 10/2007 | Kelly |
| 7,766,329 | B1 | 8/2010 | Kelly |
| 7,775,870 | B2 | 8/2010 | Kelly |
| 7,823,883 | B1 | 11/2010 | Kelly |
| 7,824,252 | B1 | 11/2010 | Kelly |
| 7,832,727 | B1 | 11/2010 | Kelly |

(Continued)

FOREIGN PATENT DOCUMENTS

| | | |
|---|---|---|
| EP | 0062433 A2 | 3/1982 |
| GB | 2096376 A | 10/1984 |

*Primary Examiner* — Michael Cuff
(74) *Attorney, Agent, or Firm* — Nixon Peabody LLP

(57) ABSTRACT

A gaming system includes one or more input devices, one or more display devices, one or more processors, and one or more memory devices storing instructions. When executed by the one or more processors, the instructions cause the gaming system to receive, via at least one of the input devices, an input indicative of a wager selected from at least one wager amount being a function of a previous wager associated with an immediately preceding wagering game. The instructions cause the gaming system to display a wagering game on the one or more displays, the wagering game being in an advantageous state relative to the immediately preceding wagering game. The instructions further cause the gaming system to display an outcome of the wagering game on the one or more displays, at least a portion of the outcome being enhanced by an outcome of the immediately preceding wagering game.

20 Claims, 8 Drawing Sheets

(56) References Cited

U.S. PATENT DOCUMENTS 7,878,506 B1 2/2011 Kelly
7,922,175 B1 4/2011 Kelly
7,922,176 B1 4/2011 Kelly
7,976,022 B1 7/2011 Kelly
8,006,977 B1 8/2011 Kelly
8,052,148 B1 11/2011 Kelly
8,096,554 B1 1/2012 Kelly
8,096,868 B2 1/2012 Trainor
8,100,401 B1 1/2012 Kelly
8,308,550 B2 11/2012 Fillipour
8,408,990 B2 * 4/2013 De Waal ..... G07F 17/3244 463/20
8,469,797 B2 6/2013 Collette
8,512,116 B2 * 8/2013 Haushalter ..... A63F 1/00 273/292
8,753,188 B2 * 6/2014 Cannon ..... G07F 17/3225 463/19
8,771,082 B2 7/2014 Arezina
8,968,073 B2 * 3/2015 Nicely ..... G07F 17/3223 463/18
2004/0185933 A1 * 9/2004 Nicely ..... G07F 17/32 463/25
2004/0242313 A1 * 12/2004 Munoz ..... G07F 17/3262 463/20
2005/0070354 A1 * 3/2005 Baerlocher ..... G07F 17/3244 463/20
2006/0030392 A1 * 2/2006 Rodgers ..... G07F 17/3265 463/16
2007/0184891 A1 * 8/2007 Thomas ..... G07F 17/32 463/20
2008/0139298 A1 * 6/2008 Rodgers ..... G07F 17/32 463/20
2008/0254848 A1 * 10/2008 Olushile ..... G07F 17/32 463/16
2009/0098921 A1 * 4/2009 Manning ..... G06Q 20/3224 463/17
2009/0197669 A1 * 8/2009 Michels ..... G07F 17/3262 463/20
2009/0325681 A1 * 12/2009 Englman ..... G07F 17/3262 463/20
2010/0124973 A1 * 5/2010 DeWaal ..... G07F 17/3244 463/20
2012/0157181 A1 * 6/2012 Jensen ..... G07F 17/32 463/20
2012/0329551 A1 * 12/2012 Arezina ..... G07F 17/32 463/25
2014/0031101 A1 1/2014 Jaffe

* cited by examiner

WAGER SELECTIONS FOR WAGERING GAMES TRUNCATED BY PRIOR WAGE LEVEL

PRIORITY CLAIM

This application is a continuation of U.S. application Ser. No. 13/796,967, filed Mar. 12, 2013, which is hereby incorporated by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to wagering games in which a second spin/play in an advantageous state as compared to a preceding spin/play has wager levels restricted by or that are a function of a wager level selected for the preceding spin/play. An outcome of the second spin/play is at least partially determined by an outcome of the preceding spin/play.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming system comprises one or more input devices, one or more display devices, one or more processors, and one or more memory devices storing instructions. When executed by the one or more processors, the instructions cause the gaming system to receive, via at least one of the one or more input devices, an input indicative of a wager, the wager being selected from at least one wager amount, the at least one wager amount being a function of a previous wager associated with an immediately preceding wagering game. The instructions further cause the gaming system to display a wagering game on the one or more displays, the wagering game being in an advantageous state relative to the immediately preceding wagering game. The instructions further cause the gaming system to display an outcome of the wagering game on the one or more displays, at least a portion of the outcome being enhanced by an outcome of the immediately preceding wagering game.

According to another aspect of the invention, a gaming system comprises one or more input devices, one or more display devices, one or more processors, and one or more memory devices storing instructions. When executed by the one or more processors, the instructions cause the gaming system to receive, via at least one of the one or more input devices, a first input indicative of a first wager. The instructions further cause the gaming system to display a first play of a wagering game on the one or more displays and display a first outcome of the first play on the one or more displays. The instructions further cause the gaming system to, in response to an occurrence of a predetermined event during the first play, place a subsequent second play of the wagering game in an advantageous state. The instructions further cause the gaming system to receive, via at least one of the one or more input devices, a second input indicative of a second wager, the second wager being selected from at least one wager amount, the at least one wager amount being a function of the first wager. The instructions further cause the gaming system to display a second play of the wagering game on the one or more displays. The instructions further cause the gaming system to display a second outcome of the second play, at least a portion of the second outcome being associated with the predetermined event of the first play.

According to another aspect of the invention, a computer-implemented method in a gaming system comprises receiving, via at least one of one or more input devices, an input indicative of a wager, the wager being selected from at least one wager amount, the at least one wager amount being a function of a previous wager associated with an immediately preceding wagering game. The method further comprises displaying, on at least one of one or more display devices, a wagering game on the one or more displays, the wagering game being in an advantageous state relative to the immediately preceding wagering game. The method further comprises displaying, on at least one of the one or more displays, an outcome of the wagering game, at least a portion of the outcome being enhanced by an outcome of the immediately preceding wagering game.

According to another embodiment of the invention, one or more physical machine-readable storage media include instructions which, when executed by one or more processors, cause the one or more processors to perform operations. The operations include receiving, via at least one of the one or more input devices, an input indicative of a wager, the wager being selected from more than one wager amounts, the more than one wager amounts being a function of a previous wager associated with an immediately preceding wagering game. The operations further include displaying a wagering game on the one or more displays, the wagering game being in an advantageous state relative to the immediately preceding wagering game. The operations further include displaying an outcome of the wagering game on the one or more displays, at least a portion of the outcome being enhanced by an outcome of the immediately preceding wagering game.

According to yet another aspect of the invention, computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1:
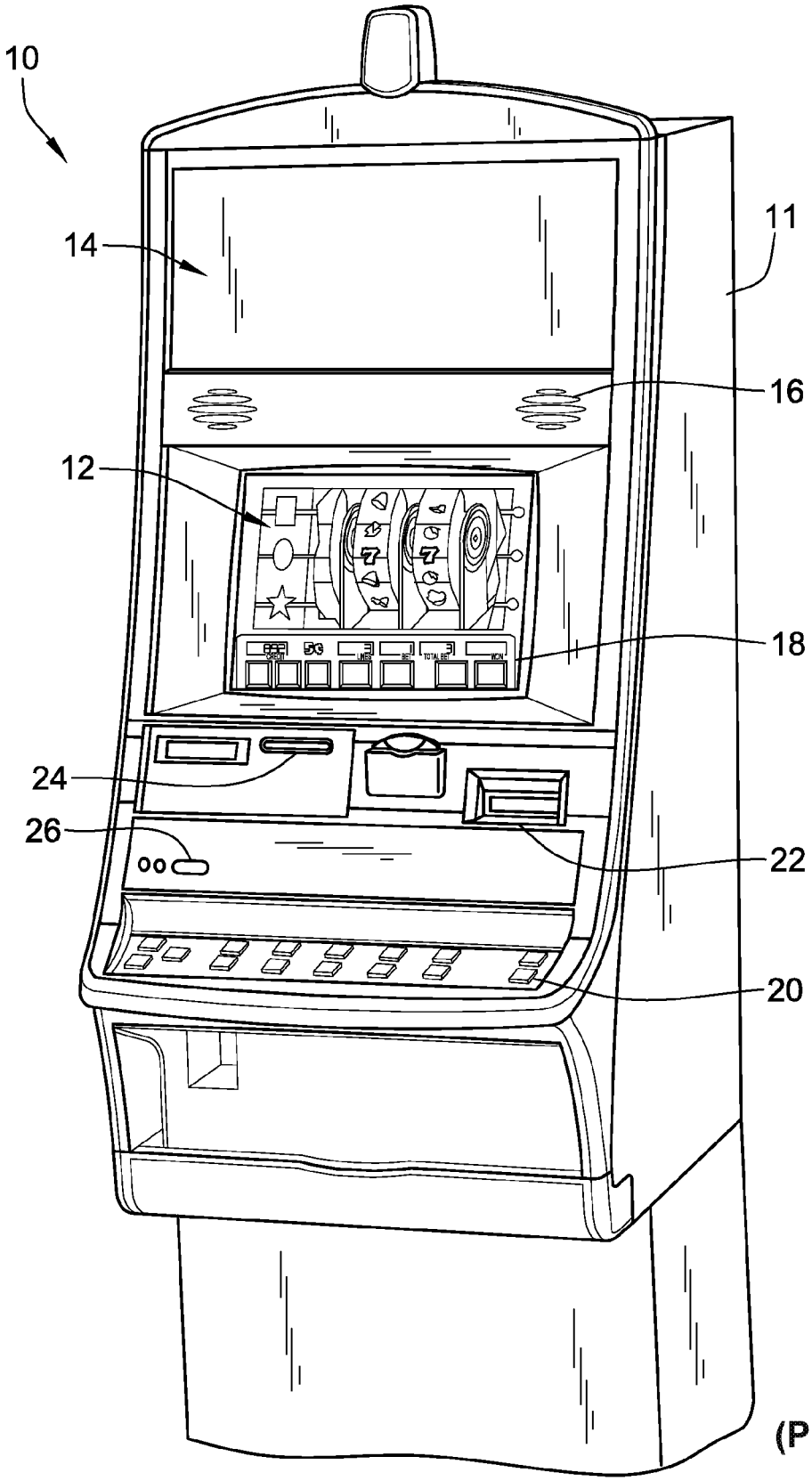
FIG. 1 (Prior Art)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
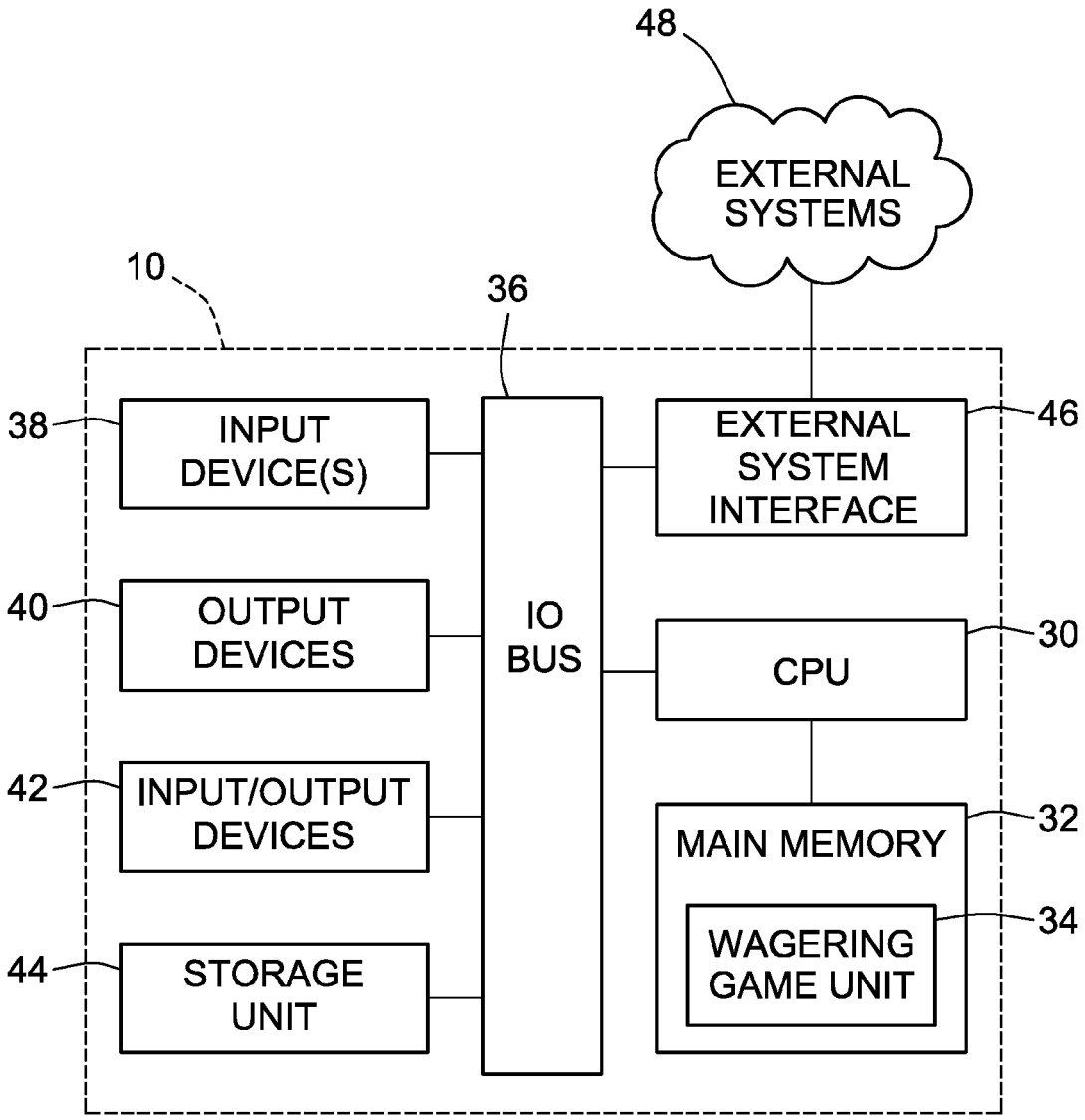
FIG. 2 (Prior Art)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
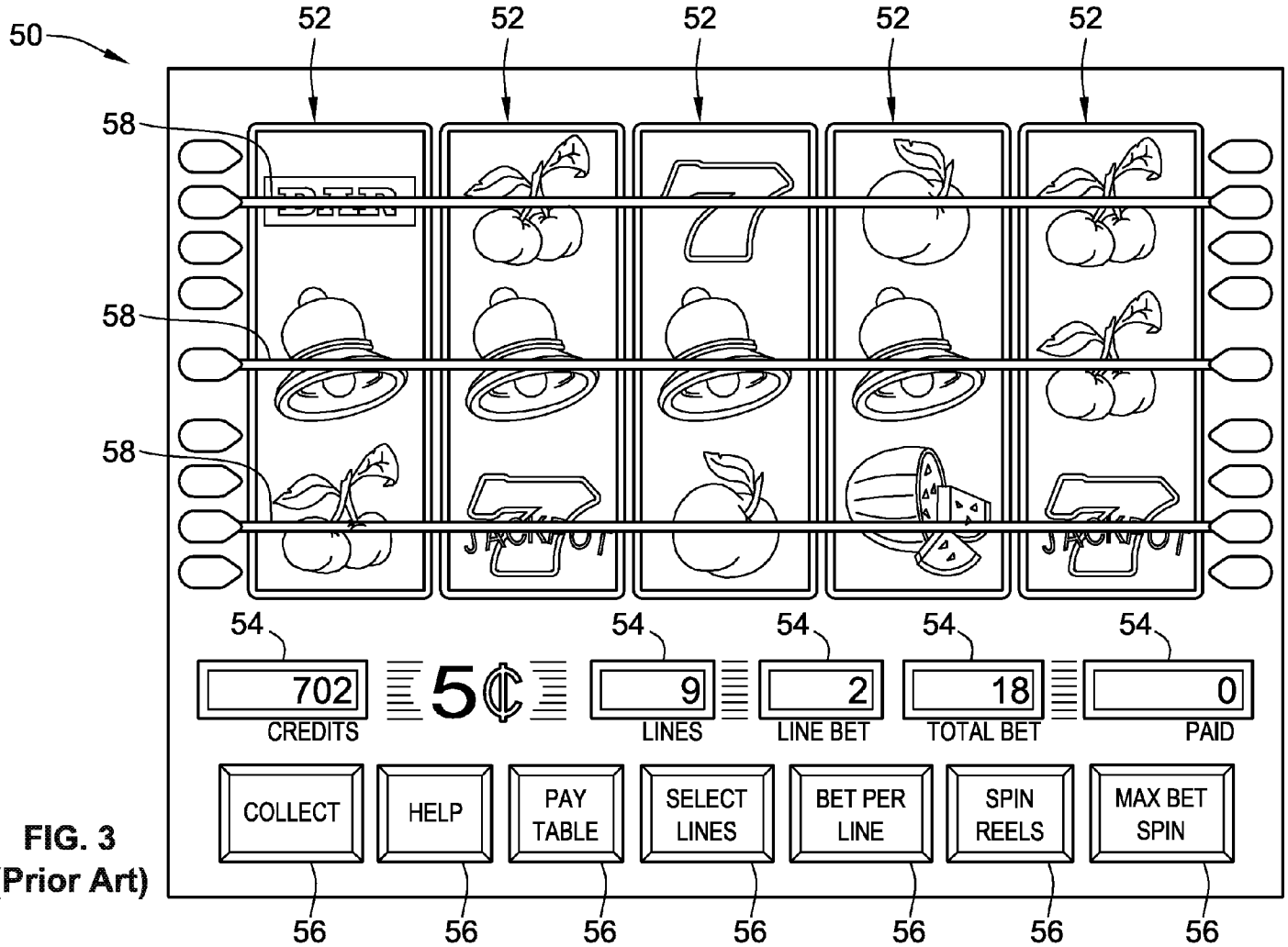
FIG. 3 (Prior Art)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
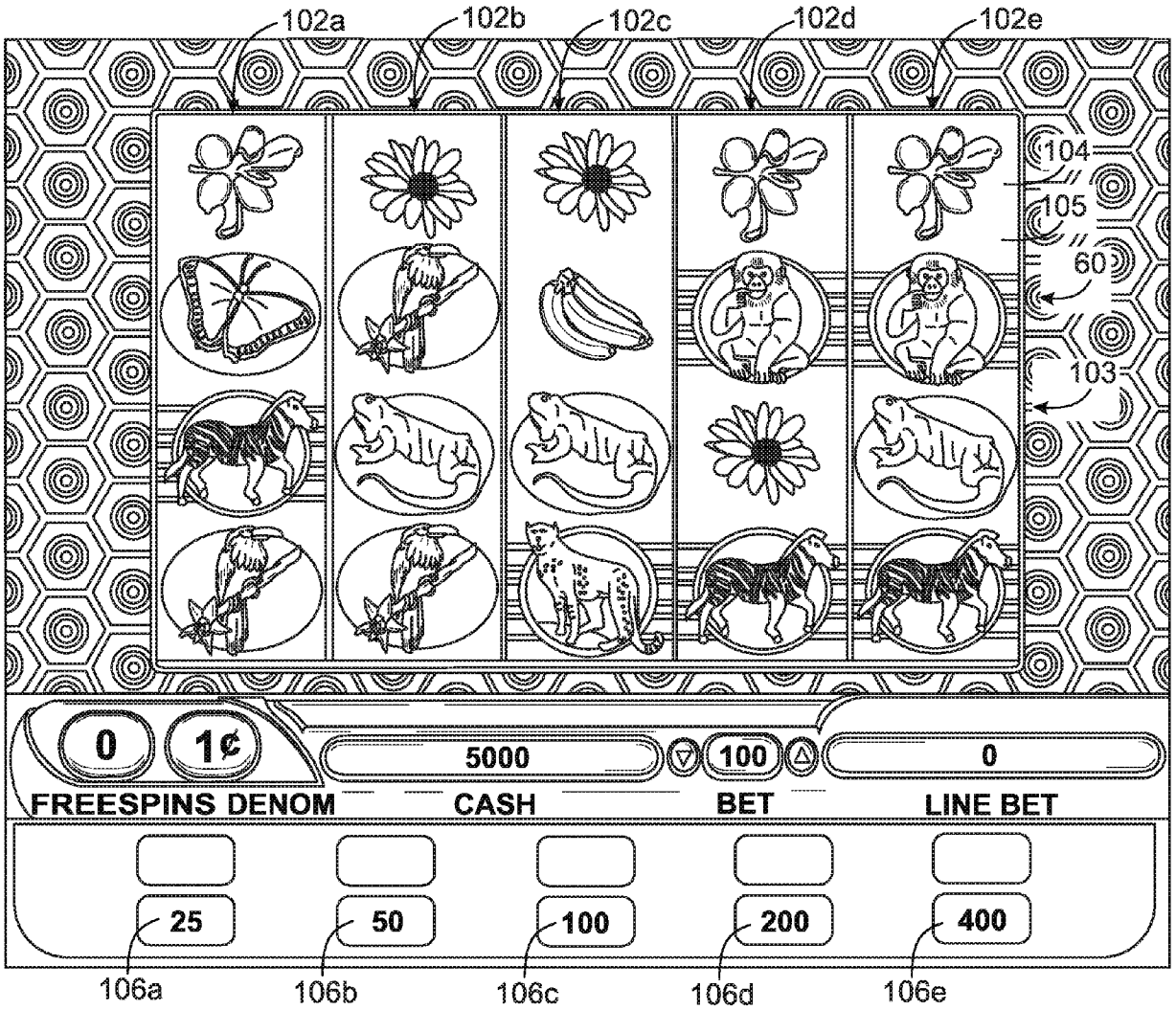
FIG. 4 is an image of a game screen displayed on a gaming terminal, according to one embodiment of the present invention.

Referring now to FIG. 4, an image of a game screen 60 is shown according to one embodiment. The game screen 600 may be displayed on the primary display 12, the secondary display 14, or a combination thereof during a wagering game or a bonus feature. The game screen 60 portrays a plurality of reels 102*a*-102*e* forming an array of symbols 103. Although in the embodiment of FIG. 4, the array of symbols 103 is a 5×5 array, it is contemplated that the array may include any suitable number of rows and/or columns. Each symbol 104 of the array 103 is positioned in a respective symbol position 105. The reels 102*a*-102*e* may include mechanical reels or other video or mechanical presentations. The reels 102*a*-102*e* may further include single-symbol reels (displaying a single symbol in a single symbol position), multiple-symbol reels (displaying a plurality of symbols in a respective plurality of symbol positions), or a combination thereof. Although in the illustrated embodiments, the symbols 104 correspond with a jungle theme, it is contemplated that any suitable types of symbols or themes may be used.

The game screen 60 of FIG. 4 includes several possible wager meters 106*a*-106*e*, each of which indicate the total wager amount that a player may wager. As shown in the respective possible wager meters 106*a*-106*e* of FIG. 4, the player may wager 25 credits, 50 credits, 100 credits, 200 credits, or 400 credits.

Figure 5:
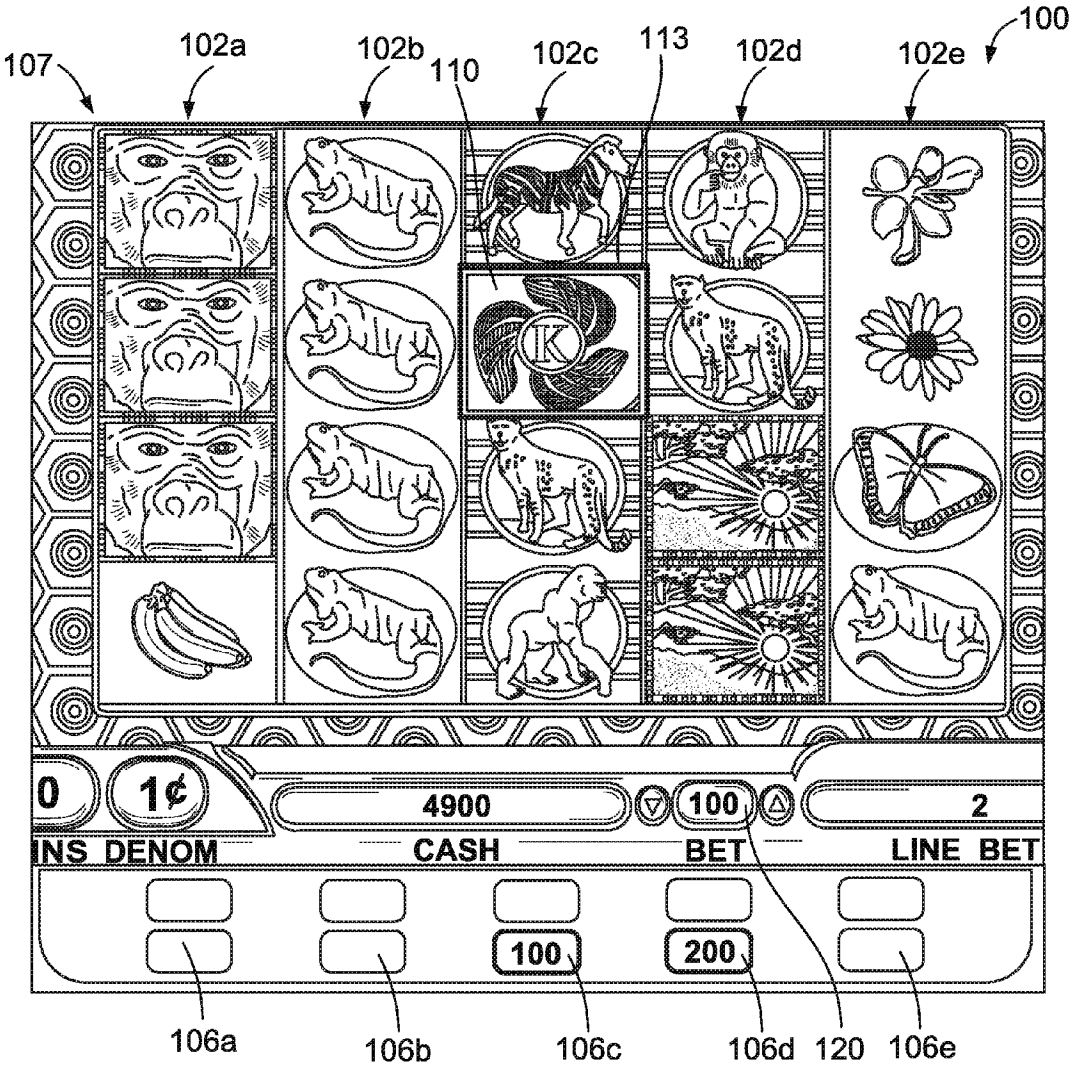
FIG. 5 is an image of a game screen subsequent to the game screen of FIG. 4.

According to the embodiments described herein, the occurrence of a predetermined event during a spin/play of a preceding wagering game places a subsequent spin/play of the wagering game in an advantageous state. In the illustrated embodiment of FIGS. 5-7, for example, the predetermined event includes the appearance of one or more "special" standard symbols in the wagering game outcome. In such an embodiment, the special standard symbol is a standard symbol on the pay table that includes indicia for indicating its "special" status. FIG. 5 shows a first outcome 107 of a wagering game, according to one embodiment, is illustrated. In the illustrated embodiment of FIG. 5, a special standard symbol 110 is a special, watermarked version of a standard "K" symbol 110. The indicia may include, for example, highlighting the standard symbol, a graphic or animation on or near the standard symbol, a border around the standard symbol, any combination thereof, or the like. The first outcome 107 is then evaluated to determine whether any winning symbol combinations in accordance with the pay table have been achieved. During the evaluation, the special standard symbol is evaluated as a standard, pay table symbol.

It is contemplated that any other suitable type of predetermined event(s) of the preceding spin/play may also trigger an advantageous state of the subsequent spin/play of the wagering game. Such predetermined events may include, but are not limited to, achieving a particular symbol combination, achieving a predetermined number of symbols in a scatter-pay outcome (e.g., anywhere in the array of symbols), randomly selecting one (or more) of the symbols of the array to be WILD in the subsequent spin, a random number appearing on the display and indicating how many WILD symbols will be achieved in the subsequent spin/game, combinations thereof, or the like.

Attention may be drawn to the occurrence of a predetermined event triggering the advantageous state of the subsequent spin/play. For example, if a special standard symbol is achieved during play or in an outcome of a wagering game, the gaming machine may activate an audio and/or visual alarm including playing special sound effect and/or displaying a graphic on a display of the gaming machine. This may be desirable to call attention to the player, thereby enhancing the player's gaming experience. This may also be desirable to attract other players who may wish to receive a similar award and/or gaming experience. In another example, a time delay is added prior to beginning the subsequent game/spin in the advantageous state to "break the rhythm" of the player and to provide the player with additional time to increase his or her wager.

Figure 6:
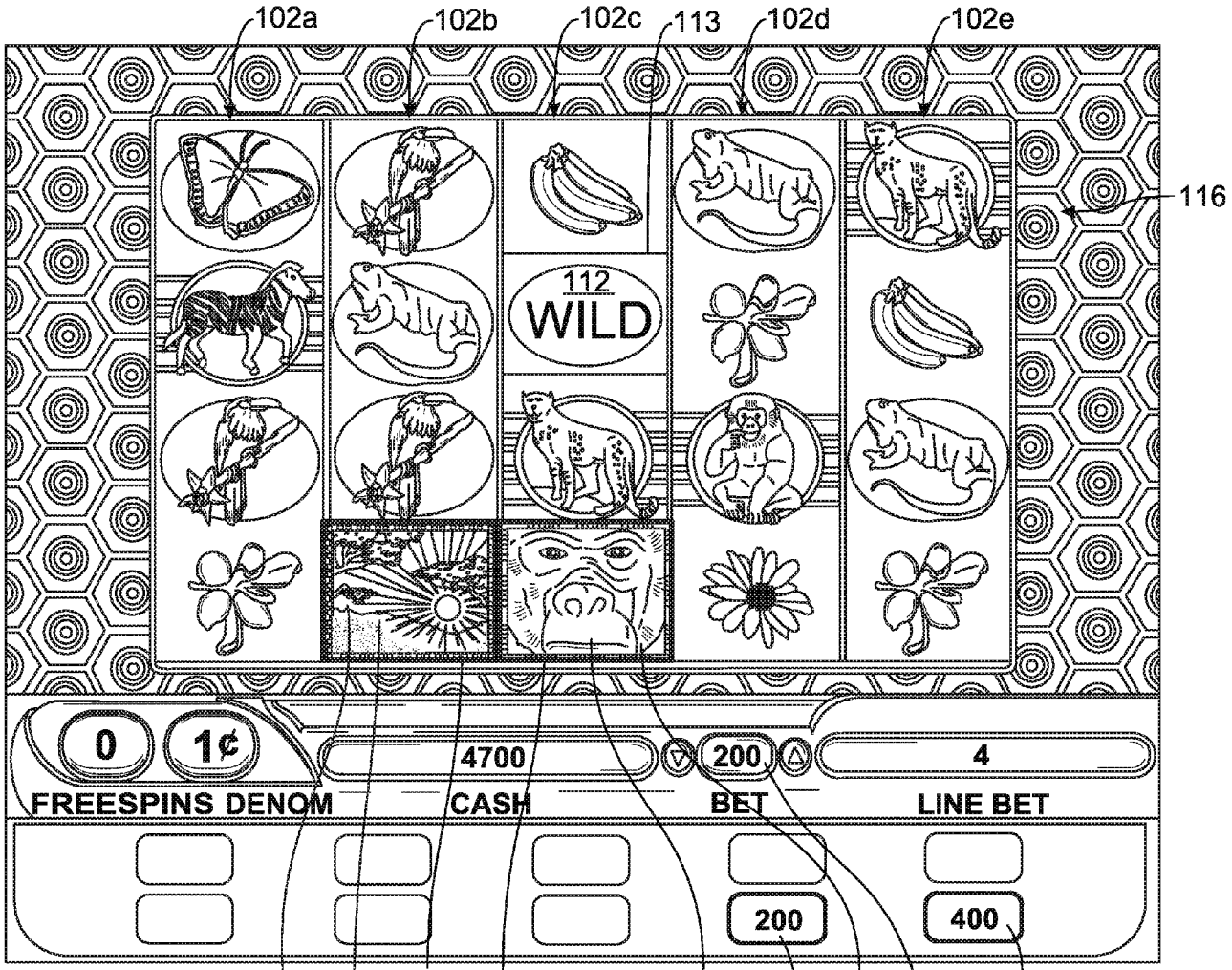
FIG. 6 is an image of a game screen subsequent to the game screen of FIG. 5.

A spin/play in an advantageous state includes an increased likelihood that a winning outcome will be achieved during that spin/play of the wagering game. In the illustrated non-limiting example, during a subsequent spin, the special standard symbol 110 of the first outcome 107 (FIG. 5) is transformed into a WILD symbol 112 and held in the same symbol position 113, as shown in the subsequent game screen 114 of FIG. 6, illustrating a second outcome 116 of a second, subsequent spin/play. In another non-limiting embodiment (not shown), the special standard symbol may multiply/expand to occupy more than one symbol position, thereby increasing the likelihood that a winning symbol combination and/or scatter pay award will be achieved. In other examples, the advantageous state may include other types of features that enhance the player's likelihood of achieving an award or a higher award in a subsequent spin/play, including, but not limited to, a guarantee of a predetermined number of WILD symbols or multipliers, substituting a higher pay table, combinations thereof, or the like.

In an advantageous state, the subsequent spin/play has a better/higher expected value as compared with the preceding spin (in which the predetermined event occurred), which was in a standard, non-advantageous state. Thus, a player will be incentivized to place a higher wager on the subsequent game(s)/spin(s). For example, some players might choose to bet a minimum amount when a wagering game is in a standard, non-advantageous state and then wish to greatly increase his/her bet to a maximum bet when an advantageous state is achieved. Such unlimited gamesmanship is generally undesirable for manufacturers and operators of wagering games. Accordingly, it may be desirable for such gamesmanship to be limited or restricted.

In some embodiments, the wager options of the subsequent advantageous-state spin/play may be restricted by the wager placed during the immediately preceding spin/play that triggered the advantageous state. Referring back to FIG. 5, for example, a "bet" meter 120 indicates that a total wager of 100 credits was placed for the first standard, non-advantageous state spin/play, the outcome 107 of which is shown in FIG. 5. The appearance of the special standard symbol 110 during the first spin/play triggered the subsequent spin/play (see FIG. 6) to be in advantageous state. As such, the amount of credits that the player may wager for the subsequent, advantageous-state spin/play is limited by (e.g., is a function of) the one hundred-credit wager of the preceding spin/play. For example, the player may be restricted to wagering a multiple of the preceding wager (e.g., 100 credits (1×) or 200 credits (2×)) in the subsequent advantageous-state spin/play. These restricted wager options are indicate by the possible wager meters 106*c* and 106*d*. In the illustrated embodiment, the possible wager meters 106*a*, 106*b*, and 106*e* have been deactivated such that the corresponding wager amounts are not displayed. In another example, the player may be limited to wagering only a predetermined amount more than the wager placed in the preceding spin/play. For example, a player may wager any amount of credits up to 2× the preceding wager, e.g., any amount up to 200 credits, using the example of FIG. 5.

Referring back to FIG. 6, the "bet" meter 120 indicates that the player chose to wager 200 credits for the subsequent, advantageous-state game. As discussed above, the special standard symbol 110 of the first outcome 107 of FIG. 5 has been transformed into a WILD symbol 112 and held in the same symbol position 113 during the subsequent spin. When the reels 102*a*-102*e* stop spinning, a second outcome 116 reveals two special standard symbols 124*a*, 124*b*, as indicated by the watermarks 126*a*, 126*b*. The second outcome 116 is then evaluated for winning outcomes. As also discussed above, the two special standard symbols 124*a*, 124*b* are evaluated as standard, pay table symbols.

According to one embodiment, since at least one additional special standard symbol 124*a*, 124*b* was achieved in the outcome 116 of the second spin/play, the wagering game may continue in an advantageous state. Thus, the player's possible wager amounts may be restricted to either 1× (200 credits) or 2× (400 credits) his or her previous wager of 200 credits (as shown in the "bet" meter 120 and the activated possible wager meters 106*d*, 106*e* of FIG. 6).

Figure 7:
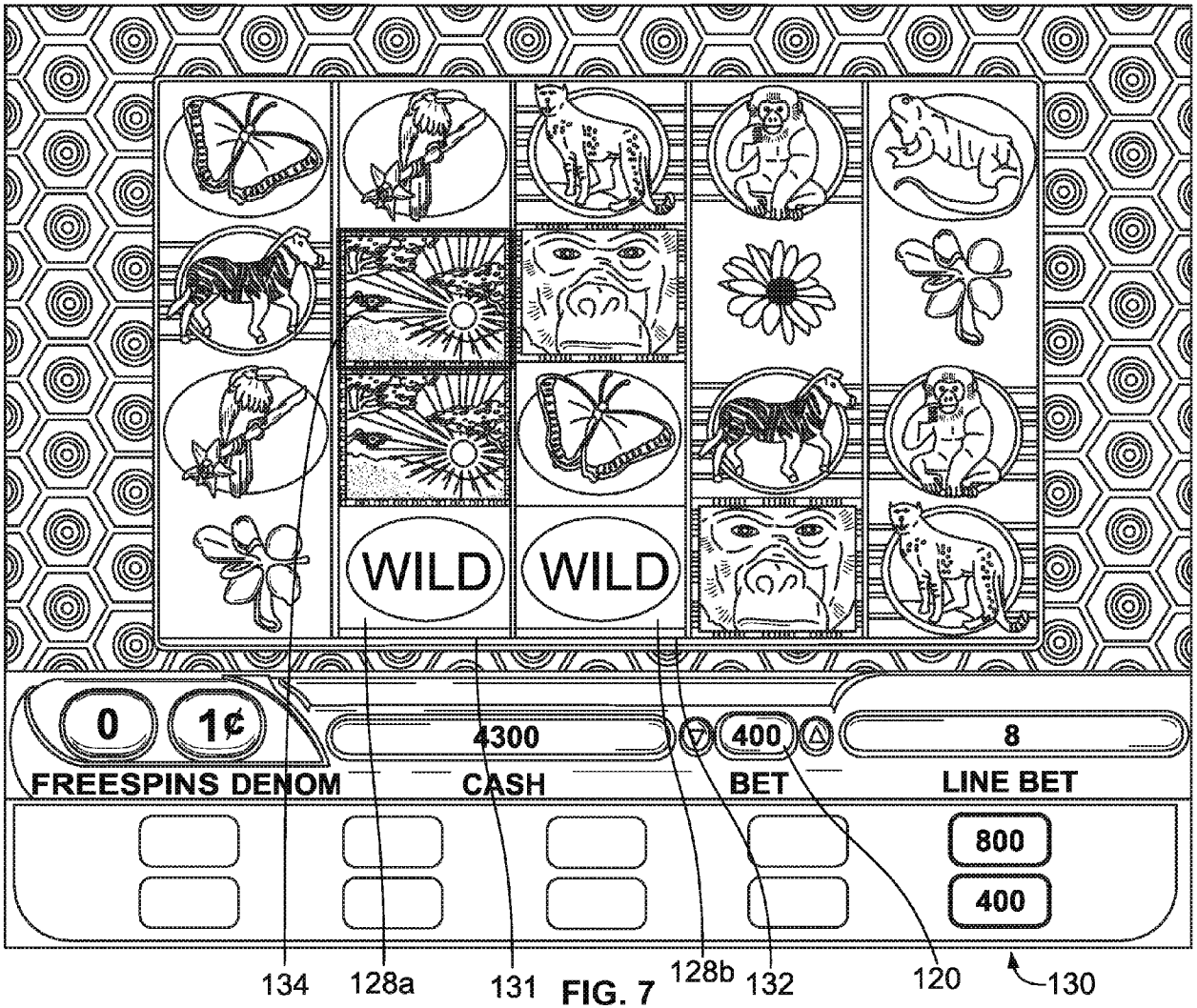
FIG. 7 is an image of a game screen subsequent to the game screen of FIG. 6.

In the illustrated embodiment, the player chose to wager the maximum wager of 400 credits, as shown in the "bet" meter 120 of FIG. 7, which illustrates a third outcome 130 of a third, subsequent spin. As also shown in FIG. 7, the special standard symbols 124*a*, 124*b* of FIG. 6 were transformed into WILD symbols 128*a*, 128*b*, respectively, and held in the same symbol positions 131, 132 during the third spin. In the embodiment shown, the WILD symbol 112 of FIG. 6 (associated with the special standard symbol 110 of the first spin/play of FIG. 5) was no longer held but, rather, was transformed back into a standard symbol during the third spin/play. In other embodiments, some or all WILD symbols may remain WILD and held until no further special standard symbols are achieved.

In some embodiments, the amount of consecutive advantageous-state spins/plays may be limited. For example, it may not be possible for another predetermined event (e.g., the appearance of special standard symbols) to occur during an advantageous-state spin/play; as such, the spin/play subsequent to an advantageous-state spin/play will necessarily be in a standard, non-advantageous state.

Additionally or alternatively, the amount of times a player may increase his or her wager based on previous spins may be restricted. In one non-limiting example, the player may be limited to incrementally increasing his or her wager based on the immediately preceding wager no more than three times in a row. Thus, in the illustrated example, since a special standard symbol 134 was achieved in the third outcome 130 of FIG. 7, the player may place a subsequent wager of 1× or 2× the preceding wager of 400 credits (e.g., 400 credits (1×) or 800 credits (2×)). However, the possible wager amounts for a subsequent, fourth spin/play may be reset such that, e.g, the player may only wager the standard amount of credits.

As discussed with respect to the illustrated embodiments, achieving a special standard symbol in a game outcome may allow a player to wager an amount of credits outside of and/or greater than the typical range of possible wager amounts. Achieving a special standard symbol may allow the player to wager more credits than the player may wager during standard play by allowing the player to e.g., double the preceding wager amount. This may be desirable so that players who wagered, e.g., a maximum wager during the first spin may still achieve an advantage and not be limited to wagering the same amount for the subsequent spin/play.

Figure 8:
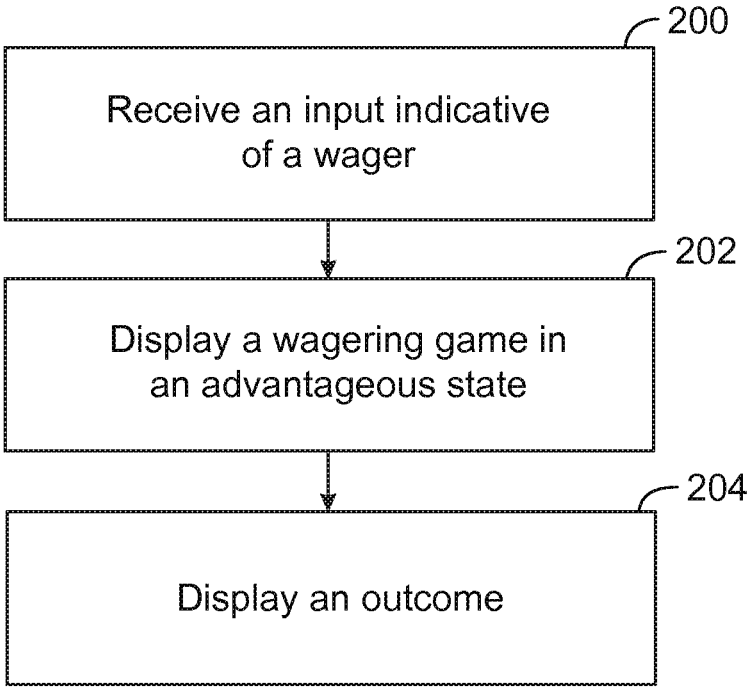
FIG. 8 is a flowchart for an algorithm that corresponds to instructions executed by a controller in accord with at least some aspects of the disclosed concepts.

FIG. 8, described by way of example above, represents one algorithm that corresponds to at least some instructions executed by the CPU 30 in FIG. 2 to perform the above described functions associated with the disclosed concepts. In step 200, a gaming system receives, via at least one of one or more input devices, an input indicative of a wager. The wager is selected from at least one wager amount. The at least one wager amount is a function of a previous wager associated with an immediately preceding wagering game. In step 202, a wagering game is displayed on one or more displays of the gaming system, the wagering game being in an advantageous state relative to the immediately preceding wagering game. In step 204, an outcome of the wagering game is displayed on the one or more displays. At least a portion of the outcome is enhanced by an outcome of the immediately preceding wagering game.

Although the embodiments herein are described with respect to reel-based wagering games, the concepts may also be applied to other types of games including, but not limited to poker-type games, keno, bonus games, or the like.

Each of these embodiments and obvious variations thereof is contemplated as falling within the spirit and scope of the claimed invention, which is set forth in the following claims. Moreover, the present concepts expressly include any and all combinations and subcombinations of the preceeding elements and aspects.

What is claimed is:

1. A gaming system comprising:

a gaming machine including an electronic display device and a value input device, the display device configured to display a wagering game; and one or more controllers configured to:

detect, via the value input device, a physical item associated with a monetary value that establishes a credit balance;

initiate a first play of the wagering game in response to a first input indicative of a first wager covered by the credit balance, the first wager being selectable from a set of possible wager amounts;

trigger, by an event in the first play, an advantageous state for a subsequent second play of the wagering game;

initiate the second play in response to a second input indicative of a second wager covered by the credit balance, the second wager being selectable from a subset of the set of possible wager amounts, the subset having fewer possible wager amounts than the set of possible wager amounts even when the credit balance is greater than or equal to the largest wager amount of the set of possible wager amounts; and award any awards resulting from the first and second plays, the awards being added to the credit balance.

2. The gaming system of claim 1, wherein the event includes at least one predetermined symbol appearing in the first play.

3. The gaming system of claim 1, wherein the second wager must be a multiple or only a predetermined amount more than the first wager.

4. The gaming system of claim 1, wherein the set of possible wager amounts are displayed on the display device for the first play, and wherein the wager amounts of the set, other than the subset, are deactivated for the second play.

5. The gaming system of claim 1, wherein in the advantageous state, the second play has a higher expected value than the first play.

6. The gaming system of claim 1, wherein in the advantageous state, the second play has a higher likelihood of achieving a winning outcome than the first play.

7. The gaming system of claim 1, wherein the first and second plays include respective spins of symbol-bearing reels of a base game of the wagering game.

8. A method of operating a gaming system including one or more controllers and a gaming machine, the gaming machine including an electronic display device and a value input device, the display device configured to display a wagering game, the method comprising:

detecting, via the value input device, a physical item associated with a monetary value that establishes a credit balance;

initiating, by at least one of the one or more controllers, a first play of the wagering game in response to a first input indicative of a first wager covered by the credit balance, the first wager being selectable from a set of possible wager amounts; triggering, by an event in the first play, an advantageous state for a subsequent second play of the wagering game;

initiating, by at least one of the one or more controllers, the second play in response to a second input indicative of a second wager covered by the credit balance, the second wager being selectable from a subset of the set of possible wager amounts, the subset having fewer possible wager amounts than the set of possible wager amounts even when the credit balance is greater than or equal to the largest wager amount of the set of possible wager amounts; and awarding, by at least one of the one or more controllers, any awards resulting from the first and second plays, the awards being added to the credit balance.

9. The method of claim 8, wherein the event includes at least one predetermined symbol appearing in the first play.

10. The method of claim 8, wherein the second wager must be a multiple or only a predetermined amount more than the first wager.

11. The method of claim 8, wherein the set of possible wager amounts are displayed on the display device for the first play, and wherein the wager amounts of the set, other than the subset, are deactivated for the second play.

12. The method of claim 8, wherein in the advantageous state, the second play has a higher expected value than the first play.

13. The method of claim 8, wherein in the advantageous state, the second play has a higher likelihood of achieving a winning outcome than the first play.

14. The method of claim 8, wherein the first and second plays include respective spins of symbol-bearing reels of a base game of the wagering game.

15. A method of operating a gaming system including one or more controllers and a gaming machine, the gaming machine including an electronic display device and a value input device, the display device configured to display a wagering game, the method comprising:

detecting, via the value input device, a physical item associated with a monetary value that establishes a credit balance;

initiating, by at least one of the one or more controllers, a first play of the wagering game in response to a first input indicative of a first wager covered by the credit balance, the first wager being selectable from a set of possible wager amounts, the first play triggering an advantageous state for a subsequent second play of the wagering game;

limiting, by at least one of the one or more controllers, an amount that may be selected for a second wager to play the second play to a subset of the set of possible wager amounts, the subset having fewer possible wager amounts than the set of possible wager amounts even when the credit balance is greater than or equal to the largest wager amount of the set of possible wager amounts based on an amount of the first wager;

initiating, by at least one of the one or more controllers, the second play in response to a second input indicative of the second wager covered by the credit balance; and awarding, by at least one of the one or more controllers, any awards resulting from the first and second plays, the awards being added to the credit balance.

16. The method of claim 15, wherein the advantageous state is triggered by at least one predetermined symbol appearing in the first play.

17. The method of claim 15, wherein the amount that may be selected for the second wager must be a multiple or only a predetermined amount more than the amount of the first wager.

18. The method of claim 15, wherein in the advantageous state, the second play has a higher expected value than the first play.

19. The method of claim 15, wherein in the advantageous state, the second play has a higher likelihood of achieving a winning outcome than the first play.

20. The method of claim 15, wherein the first and second plays include respective spins of symbol-bearing reels of a base game of the wagering game.

* * * * *